US007293558B2

(12) United States Patent
Ambrico

(10) Patent No.: US 7,293,558 B2
(45) Date of Patent: Nov. 13, 2007

(54) SYSTEM FOR LAUNCHING LIGHTWEIGHT ELEMENTS DURING FESTIVE EVENTS

(76) Inventor: Francesco Ambrico, Résidence le Clair Vallon, 38160 Saint Marcellin (FR)

( * ) Notice: Subject to any disclaimer, the term of this patent is extended or adjusted under 35 U.S.C. 154(b) by 0 days.

(21) Appl. No.: 10/535,342

(22) PCT Filed: Jul. 8, 2004

(86) PCT No.: PCT/FR2004/050318

§ 371 (c)(1),
(2), (4) Date: May 18, 2005

(87) PCT Pub. No.: WO2005/005909

PCT Pub. Date: Jan. 20, 2005

(65) Prior Publication Data

US 2006/0054152 A1 Mar. 16, 2006

(30) Foreign Application Priority Data

Jul. 9, 2003 (FR) ..... 03 50313

(51) Int. Cl.
*F41B 11/06* (2006.01)

(52) U.S. Cl. ..... 124/71; 124/74

(58) Field of Classification Search ..... 124/71, 124/69, 74, 76; 446/475; 102/336, 342, 102/346, 353, 355, 357, 360
See application file for complete search history.

(56) References Cited

U.S. PATENT DOCUMENTS 1,681,172 A * 8/1928 Cocho ..... 42/1.09
2,375,314 A * 5/1945 Mills ..... 124/57
2,964,031 A * 12/1960 Dotson ..... 124/57
3,044,360 A * 7/1962 Stefan et al. ..... 89/1.1
3,202,099 A * 8/1965 Wortley, Jr. et al. ..... 102/342
3,315,397 A * 4/1967 Gilliam et al. ..... 42/1.15
3,820,462 A * 6/1974 Jackson ..... 102/342
4,394,934 A * 7/1983 Fegley ..... 222/5
4,454,963 A * 6/1984 Fegley ..... 222/5
4,644,930 A * 2/1987 Mainhardt ..... 124/58
5,007,368 A * 4/1991 Bush ..... 116/211
5,361,524 A 11/1994 Karkau et al.
5,909,000 A * 6/1999 Rakov ..... 89/7
5,997,667 A * 12/1999 Jacobson ..... 149/37

(Continued)

FOREIGN PATENT DOCUMENTS

EP 1082986 A1 3/2001

(Continued)

*Primary Examiner*—Troy Chambers
*Assistant Examiner*—Stewart Knox
(74) *Attorney, Agent, or Firm*—Plevy, Howard & Darcy, PC

(57) ABSTRACT

A system for projecting light elements in the air, including: a casing connected to a reservoir containing the light elements and including an opening extending along a determined direction; a slide capable of sliding in the opening along the determined direction; a striker arranged in the opening and fixed with respect to the casing; a spring for sliding the slide in the opening; a shoulder for blocking the slide with respect to the casing in a stop position; a compressed gas cartridge capable of being slid along with the slide and, when the slide is blocked in the stop position, of being projected against the striker to be opened by the striker; and a channel for leading the gases released on opening of the cartridge towards the reservoir.

8 Claims, 3 Drawing Sheets

U.S. PATENT DOCUMENTS 6,450,160 B1 * 9/2002 Fu et al. ..... 124/57
6,615,815 B1 * 9/2003 Liang ..... 124/71
6,669,530 B2 * 12/2003 Du ..... 446/475
2002/0077027 A1 * 6/2002 Wu ..... 446/475
2006/0054152 A1 * 3/2006 Ambrico ..... 124/71

FOREIGN PATENT DOCUMENTS

GB 655503 A 7/1951

* cited by examiner

SYSTEM FOR LAUNCHING LIGHTWEIGHT ELEMENTS DURING FESTIVE EVENTS

CLAIM FOR PRIORITY

This application claims the benefit of French Application No. 03/50313, filed Jul. 9, 2003 and Int'l. Application No. PCT/FR2004/050318, filed Jul. 8, 2004 and is incorporated herein by reference.

The present invention relates to a system for projecting in the air light elements, especially made of paper or of plastic matter, for example, confetti or paper streamers, in festive events.

An example of a projection system corresponds to the product sold by Brezac Artifices corporation under trade name Kabuki. Such a projection system is formed of a socket on which is fastened a compressed gas cartridge. A tube containing the light elements to be projected in the air is assembled on the socket to receive the gases provided by the cartridge. A manually or automatically operable striker is capable of piercing the cartridge. The released gases then spread into the tube and project the light elements in the air.

A disadvantage of such a projection system is that it is difficult to ensure, on each use, an optimal piercing of the cartridge. Indeed, the amplitude of the kinetic power that can be transmitted to the striker to ensure the cartridge opening is generally limited. Indeed, when the projection system is manually operated, the striker is directly set going by a user, for example, by the pulling of a string. The amplitude of the power transmitted to the striker is then limited by the power that the user can develop. When the projection system is automatically operated, the striker is generally connected to a spring, maintained in the compressed state by a blocking means actuated by an electromagnet. The spring is released when the electromagnet receives a control signal. However, the light weight of the striker and the bulk constraints limit the amplitude of the kinetic power that can be transmitted to the striker.

Another disadvantage of such a projection system is that the compressed gas cartridge is fastened to the socket, for example, by screwing. It is thus necessary, between two uses of the projection system, to remove the used cartridge and to assemble in its place a new cartridge. Such removal and assembly operations generally require a non-negligible time.

The present invention aims at obtaining a system for projecting light elements, using a compressed gas cartridge, improving the cartridge opening by the striker.

The present invention also aims at obtaining a system for projecting light elements in which the replacing of the compressed gas cartridge is simple and fast.

To achieve these objects, the present invention provides a system for projecting light elements in the air, comprising a casing connected to a reservoir containing the light elements and comprising an opening extending along a determined direction; a slide capable of sliding in the opening along the determined direction; a striker arranged in the opening and fixed with respect to the casing; means for sliding the slide in the opening; means for blocking the slide with respect to the casing in a stop position; a compressed gas cartridge capable of being slid along with the slide and, when the slide is blocked in the stop position, of being projected against the striker to be opened by the striker; and means for leading the gases released on opening of the cartridge towards the reservoir.

According to a projection mode of the present invention, the projection system comprises additional means for blocking the slide with respect to the casing in an arming position in which the slide is more distant from the striker than in the stop position; and means for releasing the slide to slide into the opening from the arming position.

According to a projection mode of the present invention, the means for sliding the slide are a helical spring comprising a first end connected to the casing and a second end connected to the slide, the spring being compressed when the slide is in the arming position and being capable of being released to slide the slide between the arming position and the stop position.

According to a projection mode of the present invention, the opening comprises a shoulder for blocking the slide in the stop position.

According to a projection mode of the present invention, the slide comprises a body and at least one reinforcing piece connected to the body by a leg extending in a determined direction, the opening comprising a shoulder capable of receiving the reinforcing piece to block the slide in the arming position, the leg being deformable to release the reinforcing piece from the shoulder.

According to a projection mode of the present invention, the system comprises a socket arranged at one end of the opening, the striker being fastened to the socket, the socket comprising at least one protrusion capable of cooperating with the slide to place the slide in the arming position.

According to a projection mode of the present invention, the opening is cylindrical, the socket being capable of being rotated with respect to the casing from a first position in which the socket prevents the sliding of the slide to a second position in which the slide is free to slide.

According to a projection mode of the present invention, the reservoir is attached to the socket, said socket comprising openings for the passing of the gases released on opening of the cartridge.

According to a projection mode of the present invention, the casing comprises at least one flexible tab that can be manually actuated, capable of deforming the leg to release the reinforcing piece from the shoulder.

According to a projection mode of the present invention, the system comprises means for deforming the leg comprising a mobile arm having one end capable of deforming the leg and an electromagnet capable of actuating the arm.

The foregoing objects, features, and advantages, as well as others of the present invention will be discussed in detail in the following non-limiting description of specific embodiments in connection with the accompanying drawings, among which:

Figure 4:
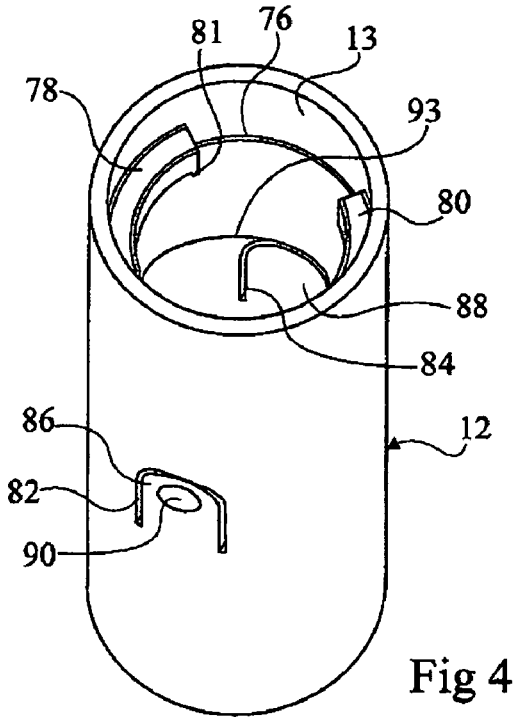
Figure 5:
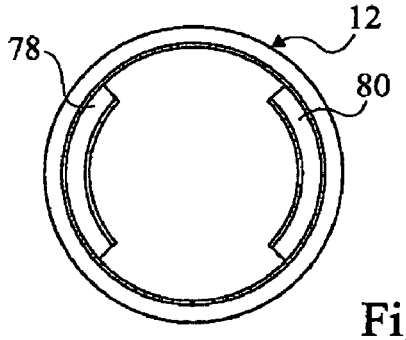
Figure 6:
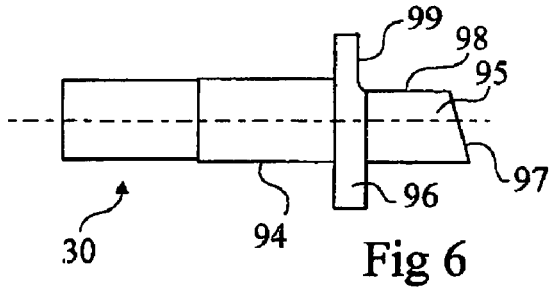
Figure 7:
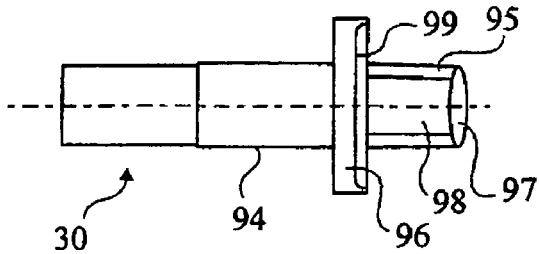
Figure 9:
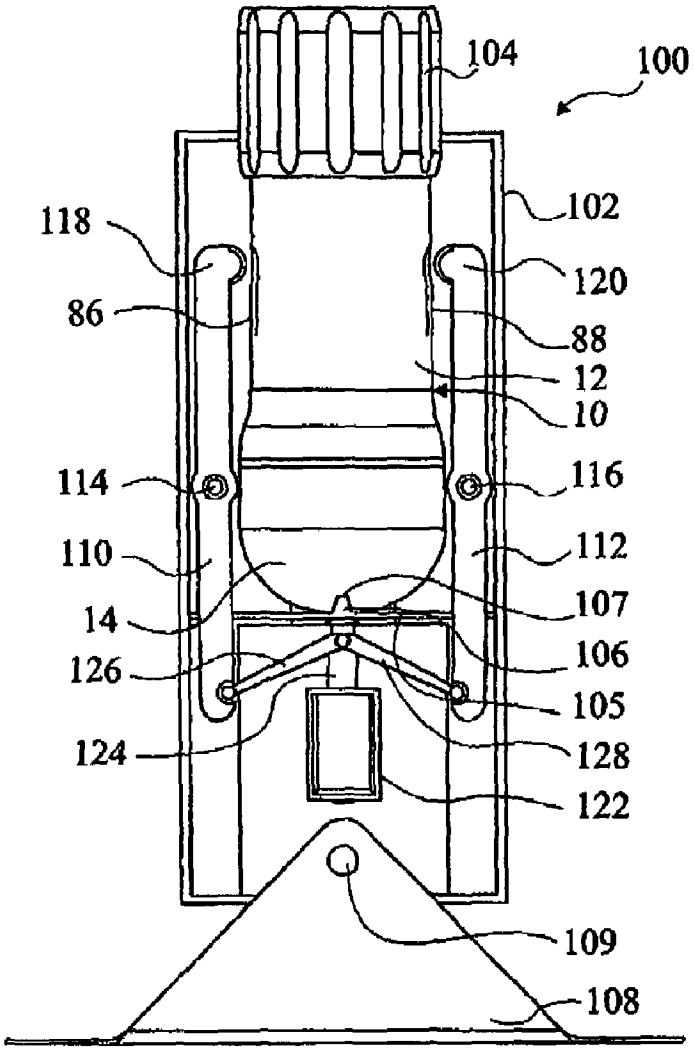
Figure 8:
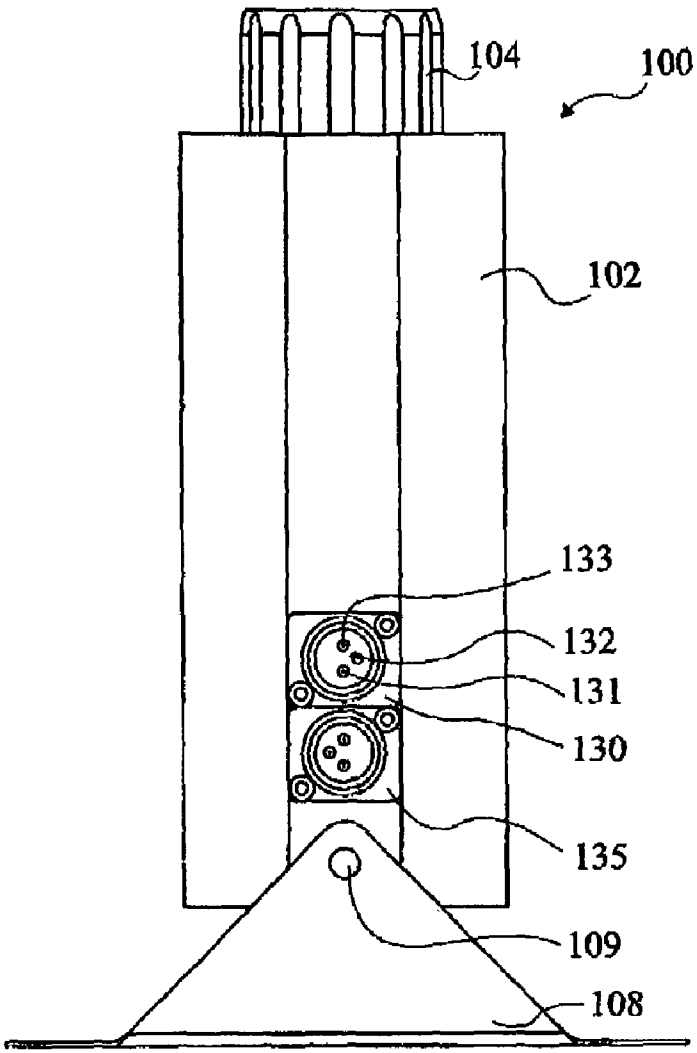

FIGS. 4 and 5 respectively show a perspective view and a top view of an element of the projection system according to the present invention;

FIGS. 6 and 7 respectively show an enlarged side view and top view of the striker of the projection system according to the present invention; and FIGS. 8 and 9 respectively show a side view and a partial front view of a device of automatic actuation of the projection system according to the present invention.

Figure 1:
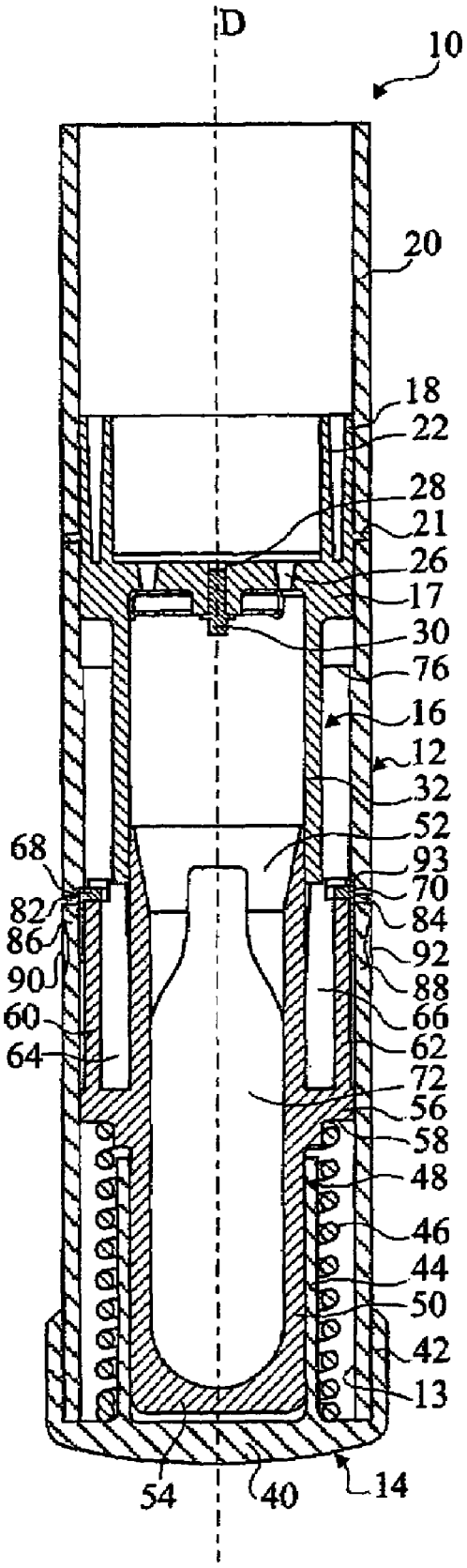
FIGS. 1 and 2 are cross-section views of the projection system according to the present invention at two successive steps of the use of the projection system.
Figure 2:
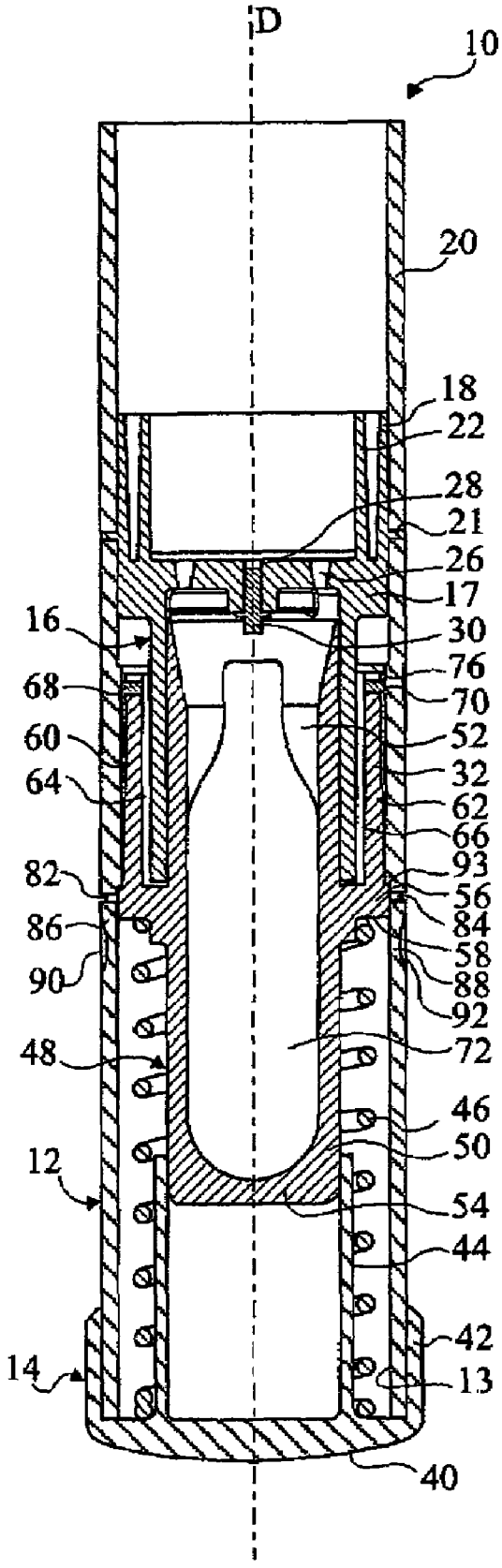
Figure 3:
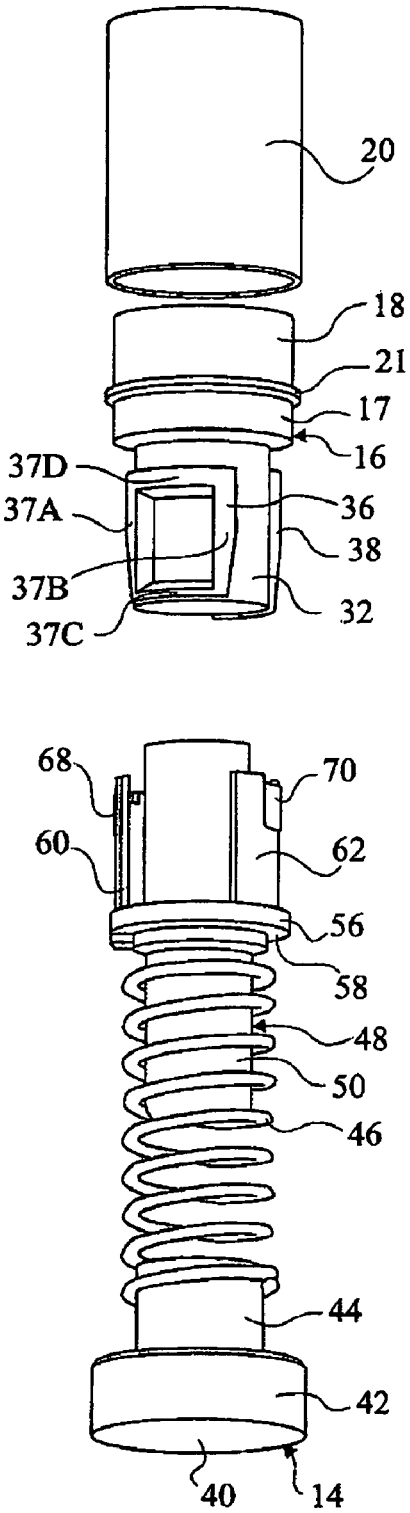
FIG. 3 shows an exploded view of elements of the projection system according to the present invention.

FIGS. 1 to 5 show several views of a projection system 10 according to the present invention. Projection system 10 comprises a cylindrical casing 12 crossed by a cylindrical opening 13 of axis D, closed by a plug 14 at one end and by a socket 16 at the opposite end. As an example, the axial length of casing 12 is of a few tens of centimeters and the inner radius of casing 12 varies from a few centimeters to some ten centimeters. Socket 16 comprises a base 17, obstructing the end of casing 12, from which projects a cylindrical support 18 according to axis D. A tube 20, a portion only of which is shown in FIGS. 1 to 3, is fastened to cylindrical support 18, for example, by stapling or gluing, and extends long axis D. Tube 20 contains light elements, not shown, especially made of paper or of plastic matter, for example, confetti or paper streamers. Tube 20 is advantageously made of cardboard, or of any low cost material, that can easily tear under the action of an internal overpressure. Cylindrical support 18 comprises a collar 21 stopping against casing 12. An auxiliary cylindrical support 22 coaxial to cylindrical support 18 and having a diameter smaller than the diameter of cylindrical support 18 projects from base 17. The arrangement of cylindrical support 18, 22 enables assembly selection between one of the following tubes: so-called large-diameter tube 20 assembled at the level of the external lateral surface of greater diameter of cylindrical support 18, a so-called intermediary diameter tube (not shown) assembled between cylindrical supports 18, 22, or a so-called small-diameter tube (not shown) assembled at the level of the inner lateral surface of smaller diameter of cylindrical support 22. Base 17 comprises openings 26 allowing passing of gases between opening 13 and the inside of tube 20. Base 17 comprises an opening 28 receiving a striker 30 which projects in protrusion with respect to base 17 in opening 13. Base 17 extends in a cylindrical wall 32 which projects along axis D into opening 13.

As more clearly appears from FIG. 3, cylindrical portion 32 comprises two diametrical protrusions 36, 38 on the external surface of cylindrical wall 32. Each protrusion 36 comprises two rectilinear portions 37A, 37B extending along axis D and connected at their ends by two circular portions 37C, 37D.

Plug 14 comprises a bottom 40 closing the end of casing 12 opposite to socket 16. An edge 42 eases the assembly of plug 14 on casing 12. Plug 14 comprises a cylindrical portion 44 which projects from bottom 40 into opening 13 along axis D. A spiral spring 46 is arranged in opening 13. One end of spring 46 bears against bottom 40 of plug 14, between cylindrical portion 44 and casing 12, cylindrical portion 44 easing the alignment of spring 46.

A slide 48 is arranged in casing 12 between socket 16 and spring 46. Slide 48 comprises a cylindrical body 50 which extends along axis D and which is partially inserted into spring 46. Cylindrical body 50 comprises an internal cylindrical cavity 52 closed at one end by a bottom 54 and opened at the opposite end. The external diameter of body 50 substantially corresponds to the inner diameter of cylindrical wall 32 of socket 16. Body 50 comprises at its median portion a collar 56 forming a shoulder 58 against which bears an end of spring 46.

Two legs 60, 62, project from collar 56, on the side of collar 56 opposite to spring 46. Each leg 60, 62 corresponds to a portion of a cylinder oriented along the axis of casing 12. A space 64, 66 is provided between each leg 60, 62 and cylindrical body 50 for the passing of cylindrical wall 32 of socket 16. A reinforcing piece 68, 70 is arranged at the free end of each leg 60, 62. Legs 60, 62 have a given resilience and are likely to deform under the action of a force transversal to axis D.

A cylindrical compressed gas cartridge 72 is arranged in internal cavity 52 of cylindrical body 50. Fastening means may be provided to maintain cartridge 72 in internal cavity 52 in the absence of significant efforts for, especially, maintaining cartridge 72 in internal cavity 52 when projection system 10 is oriented so that the free end of tube 20 points towards the ground.

Opening 13 of casing 12 comprises a shoulder 76 on the side of the close end of tube 20. Opening 13 comprises two blocking elements 78, 80 visible in FIGS. 4 and 5, having the shape of portions of cylindrical arcs which substantially diametrically project from the internal surface of casing 12 and which are arranged close to shoulder 76. The angle seen from axis D in which each blocking element 78, 80 inscribes is smaller than 90°. Each blocking element 78, 80 comprises a stop 81 at the level of one of its surfaces included in planes comprising axis D (only one stop is visible in FIG. 4). Stops 81 are arranged to be diametrical.

Casing 12 comprises in its median portion two diametrical U-shaped slots 82, 84, each delimiting a flexible tab 86, 88. A recess 90, 92 is provided at the level of each tab 86, 88 to ease handling thereof. Opening 13 comprises a shoulder 93 arranged between tabs 86, 88 and first shoulder 76 close to tabs 86, 88.

The initial assembly of projection system 10 according to the present invention is performed as follows. On the side of the end of casing 12 opposite to shoulder 76, slide 48, spring 46, and plug 14 are successively introduced. Slide 48 penetrates into opening 13 until reinforcing pieces 68, 70 of legs 60, 62 contact shoulder 93, preventing the further progression of slide 48 into opening 13. The orientation of slide 48 with respect to casing 12 is imposed by means not shown so that, when reinforcing pieces 68, 70 of slide 48 stop against shoulder 93, each reinforcing piece 68, 70 is substantially opposite to a tab 86, 88.

Through the opposite end of casing 12, a compressed gas cartridge 72 is introduced into cavity 52 of slide 48, after which casing 12 is closed by socket 16 to which is previously fastened tube 20 containing the light elements. Once placed at the level of casing 12, socket 16 is rotated around axis D. The penetration depth of socket 16 in casing 12 is such that, on rotation of socket 16, protrusions 36, 38 and base 16 catch blocking elements 78, 80 until protrusions 36, 38 contact stops 81. Projection system 10 is then substantially in the configuration shown in FIG. 1. Projection system 10 is said to be armed since it is ready to be used.

The projection of the light elements contained in tube 20 is obtained by exerting a pressure simultaneously on tabs 86, 88, which slightly deform legs 60, 62, causing the release of reinforcing pieces 68, 70 of shoulder 93. Spring 46 then abruptly releases and drives slide 48 which moves axially towards socket 16. When collar 56 of slide 48 stops against shoulder 93, slide 48 abruptly stops. Cartridge 72 is then projected against striker 30. The kinetic power acquired by cartridge 72 is sufficient to cause the opening of cartridge 72 in the shock with striker 30 and the release of the gases contained in cartridge 72. As a reaction to the shock, cartridge 72 is axially projected against bottom 54 of slide 48. The gases then spread into the free portion of internal cavity 52 and flow through openings 26 into tube 20. The resulting overpressure is sufficient to cause the expulsion of the light elements outside of tube 20. Advantageously, striker 30 is formed of a material sufficiently soft for the end of striker 30 to be blunted in the shock with cartridge 72, to impose the change of socket 16 between two uses of projection system 10. According to a variation of the present invention, a damping material is available at the level of bottom 54 of slide 48 to avoid for cartridge 72 to embed in slide 48 in the counter-shock that follows the opening of cartridge 72.

It is preferable for the end of tube 20 opposite to casing 12 to be closed by an inner capsule intended to be pierced by the overpressure present in tube 20 on release of the gases of cartridge 72. Indeed, the applicant has shown that the projection of the light elements contained in tube 20 is performed to a greater distance when tube 20 is initially closed.

Advantageously, a small clearance is provided between cylindrical body 50 of slide 48 and cylindrical wall 32 continuing base 17. This limits, on opening of cartridge 72, gas leakages between cylindrical body 50 and cylindrical wall 32, thus favoring the pressure increase in the free portion of internal cavity 52 and accelerating the gas flow through openings 26 in tube 20.

According to a variation of the present invention, an auxiliary tube (not shown), arranged at the level of cylindrical support 22 of socket 16, inside of tube 20 and containing no light elements, the light elements being provided between tube 20 and the auxiliary tube, is provided in addition to tube 20. The auxiliary tube is closed at the end opposite to cylindrical support 22. The gas release successively results in the piercing of the auxiliary tube, then of tube 20. The applicant has shown that such a configuration enables projection of the light elements to a greater distance than upon use of single tube 20.

According to another variation of the present invention, a sliding material is arranged on the internal surface of tube 20, for example paraffin, so that the light elements contained in tube 20 slide better on expulsion thereof.

After the use of cartridge 72, projection system 10 according to the present invention is such as shown in FIG. 2. To reuse the projection system after opening of a cartridge 72, a user must remove tube 20 and socket 16, then remove cartridge 72. The user then introduces a new cartridge 72 into cavity 52 of slide 48, then places a new socket 16 at the end of casing 12, socket 16 being generally already equipped with tube 20. The presence of blocking elements 78, 80 imposes a determined orientation of socket 16 with respect to casing 12 on introduction of socket 16 into casing 12 so that protrusions 36, 38 slide between blocking elements 78, 80 in the axial motion of socket 16. Each protrusion 36, 38 then presses on a leg 60, 62 of slide 48. The penetration of socket 16 then causes the penetration of slide 48 into tube 12 and compresses spring 46 until reinforcing pieces 68, 70 engage into shoulder 93 by deformation of legs 60, 62, then blocking slide 48 in axial translation. The user then rotates socket 16 according to axis D until protrusions 36, 38 stop against stops 80, 82 of blocking elements 78, 80. Projection system 10 is ready for a new use.

According to a variation of the present invention, as a reaction to the shock between cartridge 72 and striker 30, cartridge 72 is axially projected against bottom 54 of slide 48 with a sufficient force to cause the motion of slide 48 and compress spring 46 until reinforcing pieces 68, 70 engage into shoulder 93 by deformation of legs 60, 62, then blocking slide 48 in axial translation. Such a variation thus enables automatically rearming projection system 10. To reuse projection system 10, a user must withdraw tube 20 and socket 16, then remove cartridge 72. The user then introduces a new cartridge 72 into cavity 52 of slide 48, and places a new socket 16 at the end of casing 12, socket 16 being generally already equipped with tube 20. The user then rotates socket 16 according to axis D until protrusions 36, 38 stop against stops 80, 82 of blocking elements 78, 80. Projection system 10 is ready for a new use.

Projection system 10 according to the present invention is designed so that a user must simultaneously press on the two tabs 86, 88 to release the two reinforcing pieces 68, 70 from shoulder 93 and enable moving slide 48. This enables avoiding the incidental release of slide 48 when the user inadvertently presses on a single tab 86, 88 only.

According to a variation of the present invention, a magnet is arranged at the level of bottom 54 of slide 48. Cartridge 72 being generally formed of a metallic material, such a variation enables maintaining of cartridge 72 at bottom 54 of slide 48 during the handling of projection system 10, even when tube 20 is oriented downwards. Of course, the magnet action is not sufficient to oppose the projection of cartridge 72 against projector 30, when collar 56 of slide 48, driven by the release of spring 46, stops against shoulder 93 abruptly interrupting the motion of slide 48.

FIGS. 6 and 7 show enlarged detail top views of an example of the forming of striker 30. Striker 30 comprises a cylindrical rod 94 inserted into opening 28 for the fastening of striker 30 to socket 16. Striker 30 comprises a conical striking end 95 separated from rod 94 by a collar 96. The angle at the top of conical end 95 is, as an example, approximately 2 degrees. Conical end 95 comprises a chamfered wall 97. The angle formed between chamfered wall 97 and the axis of striker 30 is approximately 15 degrees. A flattening 98 extends on conical end 94 from chamfered wall 97 to collar 96. The collar comprises a recess 99 arranged on the surface of collar 96 perpendicular to the axis of striker 30 and located on the side of conical end 95. Recess 99 extends from flattening 98 to the radial end of collar 96.

Such a striker 30 enables forming an optimal opening of cartridge 72. Indeed, chamfered wall 97 eases the piercing of cartridge 72. From as soon as the beginning of the piercing of cartridge 72, gases may escape from cartridge 72 via flat 98 and recess 99. When cartridge 72 stops against collar 96, such a gas carry-off eases the recoil of cartridge 72 and enables avoiding the embedding of cartridge 72 on conical end 95.

FIGS. 8 and 9 show a device 100 of automatic actuation of projection system 10 according to the present invention.

Automatic actuation device 100 comprises a carter 102, in which is arranged a manual projection system 10 such as described previously. In FIG. 9, only casing 12 and plug 14 of projection system 10 are shown. Plug 14 has a rounded shape. Advantageously, a ribbed collar 114 is arranged around casing 12 to ease its grasping. Carter 102 comprises a base 105 on which plug 14 bears. A rectilinear rib 106 extends on wall 105 and cooperates with a groove 107 provided on bottom 14 of casing 12. The cooperation of rib 106 and of groove 107 blocks casing 12 in rotation with respect to carter 102.

Carter 102 is pivotally assembled on a base 108 via a pivoting link 109. The inclination of carter 102 with respect to base 108 defines the direction of projection of the light elements.

Carter 102 comprises two substantially diametrical pivoting arms 110, 112 with respect to casing 12 and each rotatably assembled in its median portion on a pivot 114, 116. Each arm 110, 112 comprises at one end a bulging 118, 120 arranged opposite to a tab 86, 88 of casing 12. An electromagnet 122 is arranged in carter 102 and is controlled by a control circuit, not shown. A rod 124 is assembled to freely slide with respect to electromagnet 122 and is capable of penetrating into electromagnet 122 when the latter conducts a current. A connecting rod 126, 128 connects the end of each arm 110, 112 opposite to bulging 118, 120 to rod 124. Each connecting rod 126, 128 is rotatably assembled on arm 110, 112 and on rod 124. When electromagnet 122 conducts no current, return means, not shown, place rod 124 in a position where it is most withdrawn from electromagnet 122. Connecting rods 126, 128 then rotate arms 110, 112 so that bulgings 118, 120 are not in contact with tabs 86, 88 of casing 12.

When the control circuit supplies electromagnet 122, rod 124 penetrates into electromagnet 122. Connecting rods 126, 128, driven by rod 124, rotate pivoting arms 110, 112 so that each bulging 118, 120 bears against a tab 86, 88. This causes the release of slide 48 from projection system 10, as explained previously. The control circuit of electromagnet 122 comprises a capacitor storing the power required for the supply of electro-magnet 122, a power transformer arranged between the capacitor and electromagnet 122, and a control circuit of the capacitor.

Carter 102 comprises an input jack 130 with three terminals 131, 132, 133. As an example, a supply voltage, for example, on the order of 24 volts, is applied between terminals 131 and 132 and enables charging of the capacitor of the control circuit of electromagnet 112. A control voltage of the control circuit is applied between terminals 131 and 133 and supplies the control circuit of the capacitor to cause the capacitor discharge into electromagnet 122. A diode may be arranged at the level of carter 102 to indicate a proper charge of the capacitor.

Carter 102 may comprise an output jack 135 enabling series connection of several automatic actuation devices 100 according to the present invention.

The present invention has many advantages:

First, the releasing of slide 48 by a compression spring 46 enables developing significant forces favoring a wider opening of cartridge 72 in the shock with striker 30, thus causing a better release of the gases contained in cartridge 72 and thus better projection of the light elements contained in tube 20. Further, the volume present in internal cavity 52 of slide 48 enables better expansion of the gases expelled from cartridge 72 and favors a better projection of the light elements.

Second, since compressed gas cartridge 72 is not fastened to the projection system, it can be very rapidly replaced.

Third, the operation of the light element projection system is very simple since it requires a simple pressing on tabs 86, 88.

Of course, the present invention is likely to have various alterations and modifications which will occur to those skilled in the art. In particular, the number and the distribution of the openings of the socket enabling passing of the gases released by the cartridge depend on the dimensions of the cartridge and of the tube containing the light elements to be projected.

The invention claimed is:

1. A system for projecting light elements in the air, comprising:

a casing connected to a reservoir containing the light elements and comprising an opening extending along a determined direction;

a slide capable of sliding in the opening along the determined direction;

a striker arranged in the opening and fixed with respect to the casing;

a spring for sliding the slide in the opening;

a shoulder blocking the slide with respect to the casing in a stop position;

a compressed gas cartridge being slid along with the slide, wherein when the spring slides the slide until it is blocked in the stop position, the kinetic energy of the compressed gas cartridge then projects the compressed gas cartridge against the striker to be opened by the striker;

a channel for leading the gases released on opening of the cartridge towards the reservoir;

at least one protrusion extending from the slide and for blocking the slide with respect to the casing in an arming position in which the slide is more distant from the striker than in the stop position;

at least one flexible member for releasing the slide to slide into the opening from the arming position; and a socket arranged at one end of the opening, the striker being fastened to the socket, the socket comprising at least one protrusion capable of cooperating with the slide to place the slide in the arming position.

2. The projection system of claim 1, in which the spring comprises a helical spring having a first end connected to the casing and a second end connected to the slide, the spring being compressed when the slide is in the arming position and being capable of being released to slide the slide between the arming position and the stop position.

3. The projection system of claim 1, in which the shoulder blocking the slide in the stop position is in the opening.

4. The projection system of claim 1, in which the slide comprises a body and at least one reinforcing piece connected to the body by a leg, the shoulder receiving the reinforcing piece to block the slide in the arming position, the leg being deformable to release the reinforcing piece from the shoulder.

5. The projection system of claim 1, in which the opening is cylindrical, the socket being capable of being rotated with respect to the casing from a first position in which the socket prevents the sliding of the slide to a second position in which the slide is free to slide.

6. The projection system of claim 1, in which the reservoir is fastened to the socket, said socket comprising openings for the passing of the gases released on opening of the cartridge.

7. The projection system of claim 4, in which the at least one flexible member comprises at least one flexible tab that can be manually actuated, capable of deforming the leg to release the reinforcing piece from the shoulder.

8. The projection system of claim 4, comprising means for deforming the leg comprising a mobile arm having one end capable of deforming the leg and an electromagnet capable of actuating the arm.

* * * * *